United States Patent [19]

Anderson et al.

[11] Patent Number: 4,662,532

[45] Date of Patent: May 5, 1987

[54] FOLDABLE CONTAINER

[75] Inventors: Fredric E. Anderson; Garry M. Grzesiak; Gary J. Rosenberg, all of Stevens Point, Wis.

[73] Assignee: Steel King Industries, Inc., Stevens Point, Wis.

[21] Appl. No.: 794,779

[22] Filed: Nov. 4, 1985

[51] Int. Cl.[4] ..... B65D 21/02

[52] U.S. Cl. ..... 220/7; 220/6; 220/1.5; 220/19

[58] Field of Search ..... 220/7, 8, 6, 4 F, 4 A, 220/1.5, 19

[56] References Cited

U.S. PATENT DOCUMENTS

| | | | |
|---|---|---|---|
| 2,607,205 | 8/1952 | Morris, Jr. | 220/8 |
| 3,463,343 | 8/1969 | Asenbauer | 220/8 |
| 3,981,410 | 9/1976 | Schurch | 220/1.5 X |
| 4,150,762 | 4/1979 | Brunette | 220/19 |
| 4,186,841 | 2/1980 | Buckley et al. | 220/6 |
| 4,339,047 | 7/1982 | Johansson et al. | 220/6 X |

OTHER PUBLICATIONS

Brochure—"Rigid Container with Folding Features'-'—Steel King Industries, Inc.

*Primary Examiner*—Steven M. Pollard

*Attorney, Agent, or Firm*—Burd, Bartz & Gutenkauf

[57] ABSTRACT

An object and bulk material holding container having a floor attached to corner units for supporting upright walls. The corner units have enclosed pockets for receiving lower ends of the posts joined to the walls. Cooperating notch and tabs on the posts and corner units function in conjunction with the lower ends of the posts to hold the walls in generally upright positions. Foldable gates extend adjacent posts. The gates can be folded down onto the top of the floor along with the walls to place the container in a collapsed storable condition. In one form the floor has laterally movable extensions that are locked in selected positions to change the width of the floor.

45 Claims, 24 Drawing Figures

FIG. 1
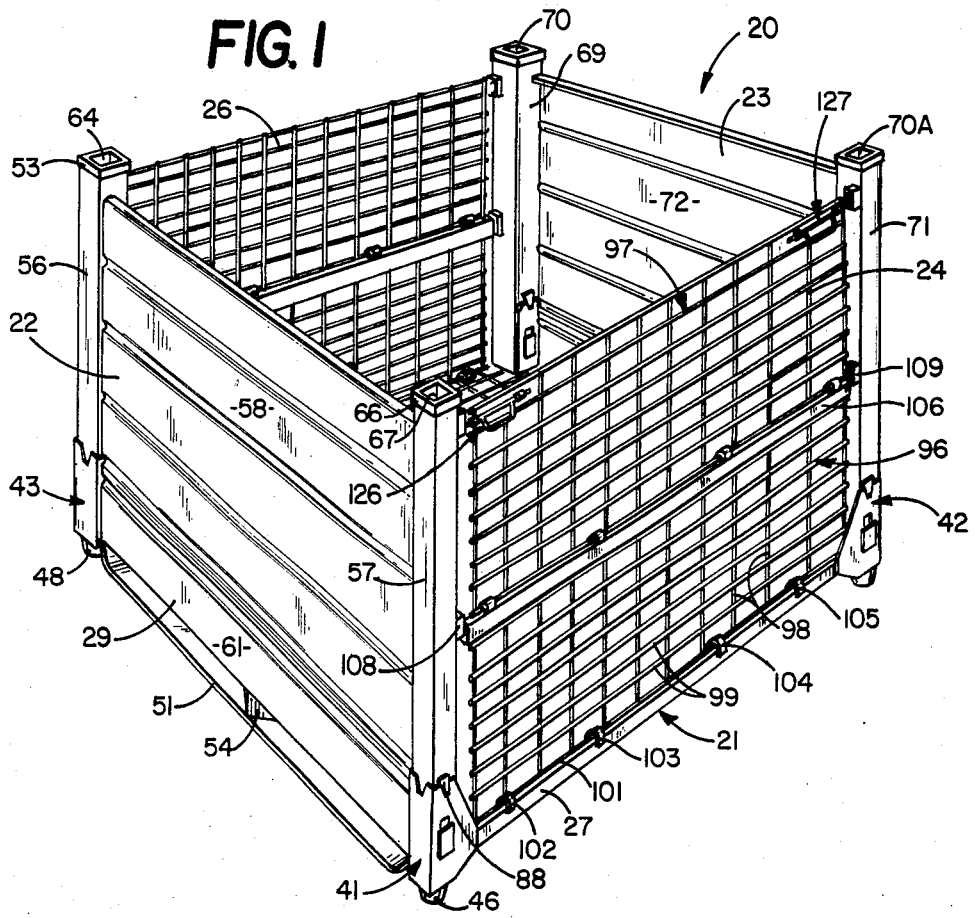
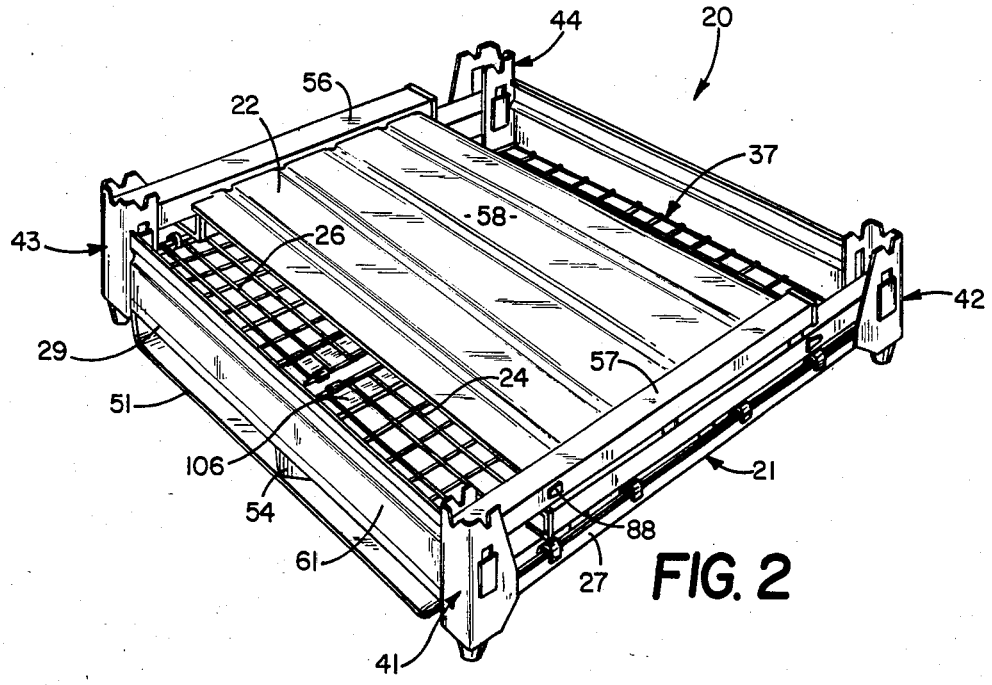
FIG. 2

FOLDABLE CONTAINER

FIELD OF INVENTION

Containers for bulk materials and objects are the subject matter of the invention. The containers include a box-like structure having upright side and end walls that fold down over a floor to provide a compact and portable unit.

BACKGROUND OF INVENTION

Wood and metal boxes are used to store and transport objects and bulk materials in industrial and commercial applications. The boxes are open top containers having a floor unit permanently attached to upright, side and end walls. The corners of the containers may be reinforced with upright legs which support the containers on a supporting surface or the ground. The floor unit may be elevated above the support surface to enable forklift vehicles to move the container and stack it on top of another container. Empty containers are either stored or shipped to a location where they can be reloaded. The containers occupy considerable space which is a disadvantage during storage and empty shipping. Containers have been provided with removable side and end walls which allow them to be taken apart for storage and shipping. The separate side and end walls can be lost or damaged. Considerable time and labor are used to take these containers apart and put them back together. Containers have been constructed with folding end walls and drop gates mounted on floor units. The end walls and gates are hinged to a floor unit so that they can be folded down onto the top of the floor unit. Releaseable locks associated with corner assemblies are used to hold the end walls in a generally upright position. The folding container of this invention is an improvement of the prior art folding containers.

SUMMARY OF INVENTION

The invention is directed to a container with upright walls having posts mounted on corner means attached to a base or floor unit. The walls of the container are adapted to be folded down in a generally flat position on top of the floor unit so that they can be stored and shipped in a relatively confined space. Each corner means has generally upright walls providing an open top enclosed pocket. The posts include lower ends that are adapted to be confined within the pockets. Cooperating means on the posts and corner means hold the posts in upright positions. The posts are movably connected to the corner units to allow a limited upright movement sufficient to move the lower ends from the pockets and release the cooperating means. The raised walls are free to be moved to folded positions on the top of the floor unit.

In one embodiment of the container, corner means are attached to a generally rectangular floor assembly supported on the ground with skids. The container has end walls having generally upright posts. Each post has a lower end locatable in an open top enclosed pocket in a corner means. Each corner means has notches for receiving tabs on a post to retain the post in the generally upright position. Upright side walls are releasably connected to the posts to complete a box-like container. The side walls are connected to the posts with releasable latch means which in cooperation with the side walls retain the posts in assembled relation with their corner means. The latch means can be disconnected from the posts to allow the side members to be folded down onto the top of the floor unit. The end walls can be raised to move the lower ends of the posts out of the pockets and release the tops from the notches to allow them to be folded down on top of the folded side walls. The entire container is folded into a relatively flat condition which allows for compact storage and shipping.

Another embodiment of the container has a floor assembly joined to corner means for accommodating generally upright posts. The posts have lower ends located within open top enclosed pockets for each corner unit. Cooperating tab and notch structures retain the posts in generally upright positions. The floor assembly has laterally movable extensions which can be locked in selected lateral positions to alter its width. The lateral extensions can be moved to an in or contracted position. The posts can be folded down on top of the floor unit to provide a compact folded container.

DESCRIPTION OF DRAWINGS

FIG. 1 is a perspective view of the container of the invention in an erected position;

FIG. 2 is a perspective view of the container in the folded position;

DESCRIPTION OF EMBODIMENTS

Referring to FIGS. 1 and 2, there is shown the container of the invention indicated generally at 20 for supporting objects, bulk materials and the like. Container 20, as shown in FIG. 1, is a open top box structure. FIG. 2 shows the container 20 in its folded position for storage and transport.

Figure 3:
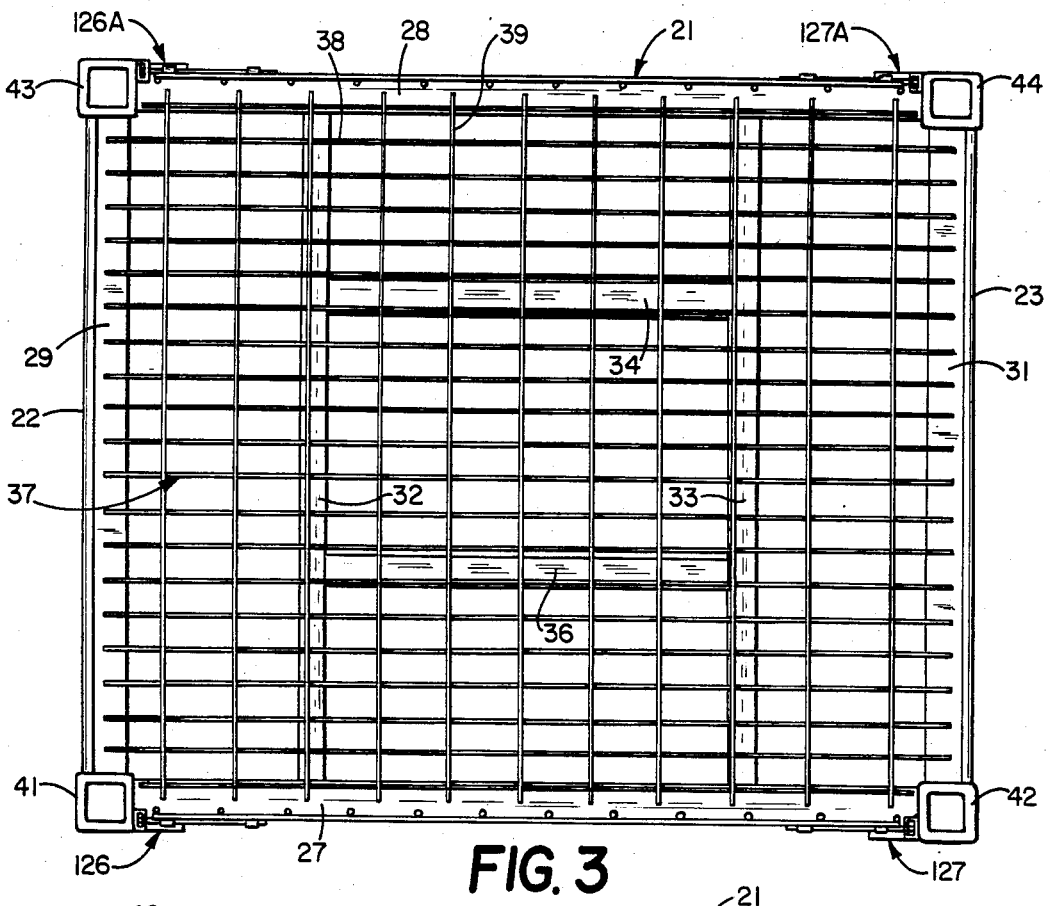
FIG. 3 is an enlarged top view of FIG. 1.
Figure 4:
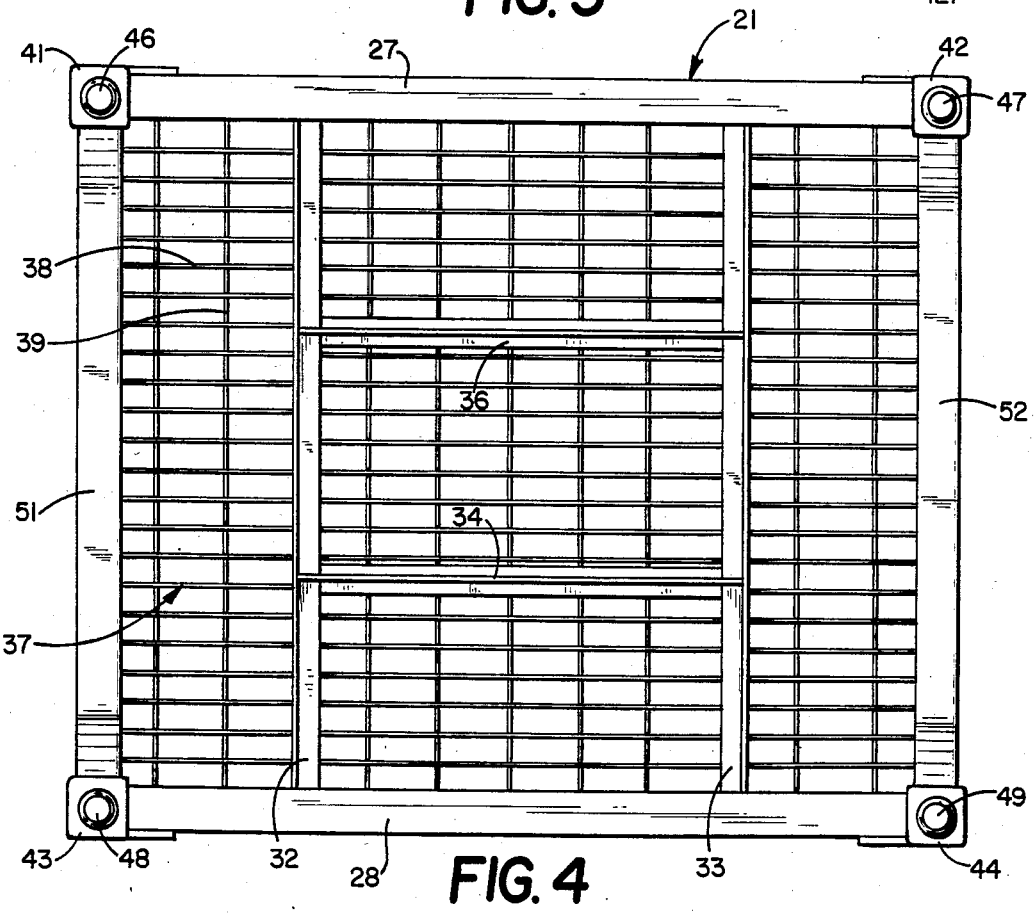
FIG. 4 is a bottom view of FIG. 3.
Figure 6:
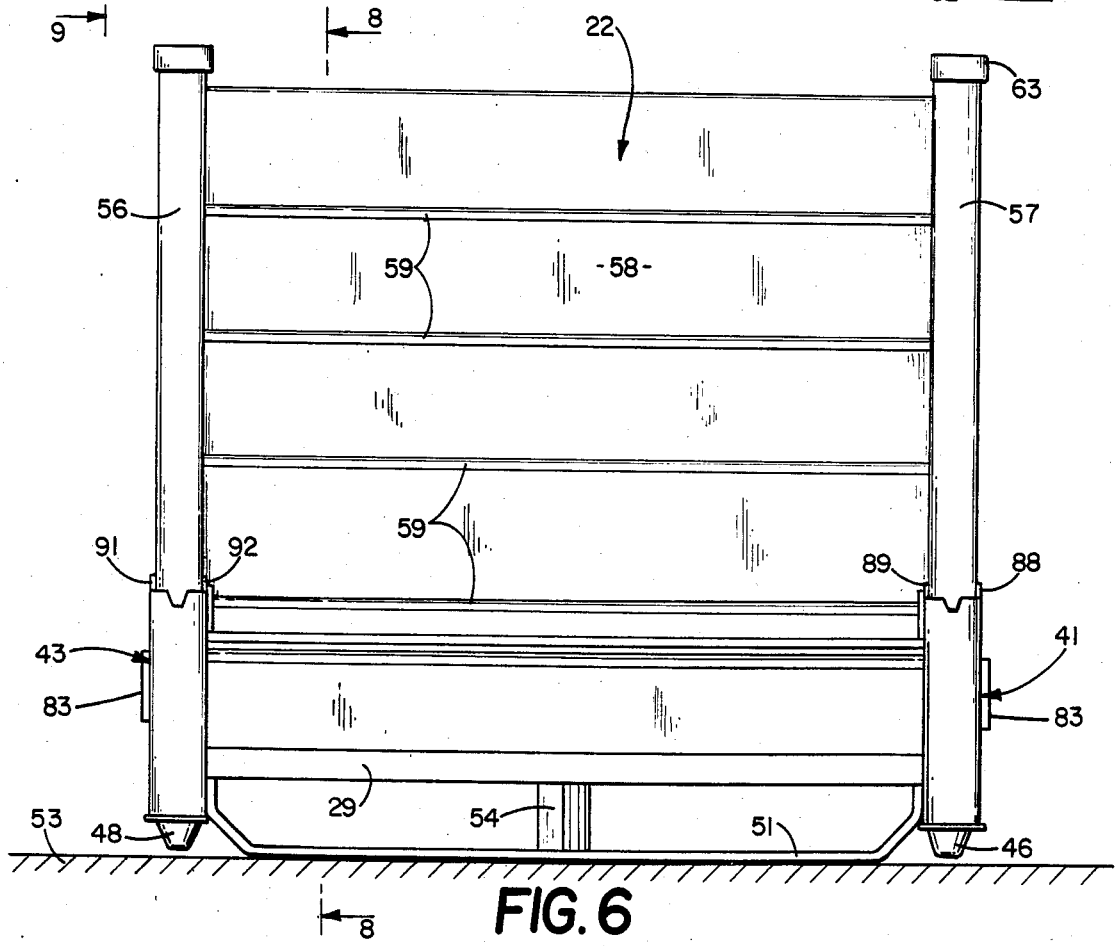
FIG. 6 is an end view of the container of FIG. 1.

Container 20 has a base unit 21 attached to end walls 22 and 23. Side walls or gates 24 and 26 extend between end walls 22 and 23 to form the box-like structure. Base unit 21, as shown in FIGS. 3 and 4, has a pair of longitudinal side rails or beams 27 and 28 and transverse end members 29 and 31. As shown in FIG. 4, a pair of cross beams 32 and 33 extend between and are joined to side rails 27 and 28. A pair of longitudinal beams 34 and 36 extend between and are secured to cross beams 32 and 33. An open mesh rod floor 37 is secured to side rails 27 and 28 and end members 29 and 31. Floor 37 comprises a plurality of laterally spaced longitudinal rods 38 and a plurality of laterally spaced transverse rods 39. The floor can be solid or slotted wood, sheet metal, or the like. Base unit 21 has corner units 41, 42, 43, and 44 joined to adjacent ends of side rails 27 and 28 and end members 29 and 31. As shown in FIG. 4, stacking plugs 46, 47, 48, and 49 are secured to the bottom of each of corner units 41–44 respectively. Base unit 21 has a pair of skid bars 51 and 52 for supporting the container on floor 53. As shown in FIG. 6, skid bar 52 extends between the corner units 42 and 44 below end member 29. An upright post 54 connects the midsection of skid bar 52 to end member 29.

Figure 8:
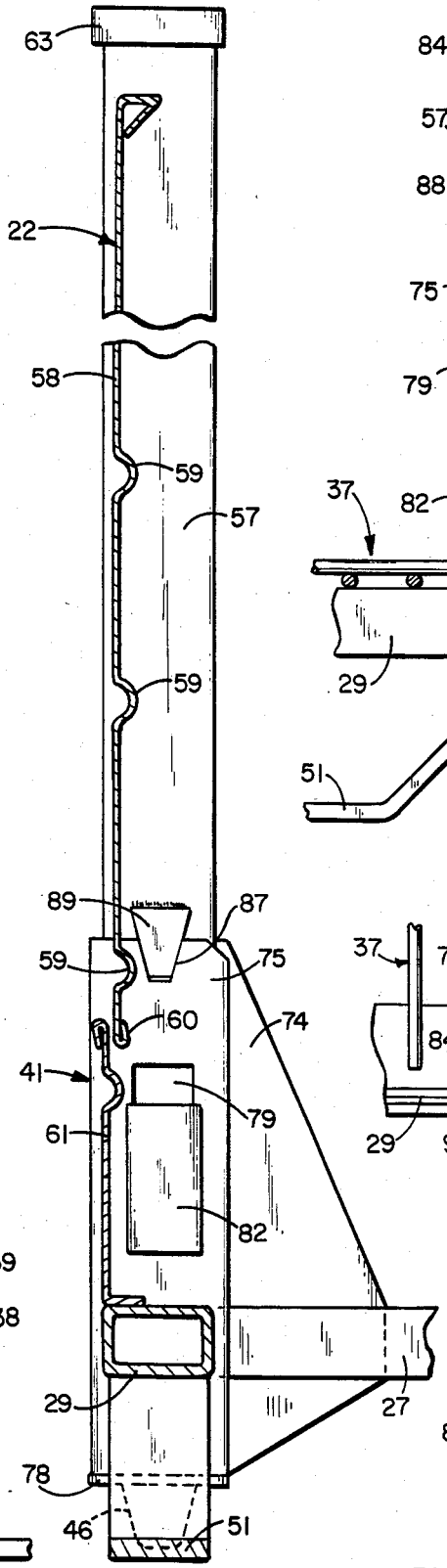
FIG. 8 is an enlarged foreshortened sectional view taken along the line 8—8 of FIG. 6.

Referring to FIG. 6, end wall 22 is mounted on corner units 41 and 43 and extends in a generally upright direction. End wall 22 has a pair of upright posts or columns 56 and 57 and an upright wall 58. Wall 58 extends between posts 56 and 57 and is secured thereto. Wall 58 is a metal sheet member having a plurality of horizontal reinforcing ribs 59. As shown in FIG. 8, the lower portion of wall 58 has a downwardly directed transverse lip 60 located adjacent the inside of the upper edge of an upright wall 61 secured to the top of end member 29. Returning to FIG. 1, the top of posts 56 and 57 are reinforced with collars 63 and 66 surrounding holes 64 and 67. End wall 23 is identical in construction to end wall 22. End wall 23 has a pair of upright posts or tubular columns 69 and 71 mounted on corner units 42 and 44. An upright wall 72 extends between posts 69 and 71. Opposite ends of wall 72 are secured by welds or the like to posts 69 and 71. The top of posts 69 and 71 have holes 70 and 70A. The plugs on the bottom of similar size second container are adapted to fit into the holes in the top of posts 56, 57, 69 and 71 to facilitate the stacking of the second container on top of container 20.

Corner units 41–44 are identical in structure. The following description is directed to corner unit 41. Referring to FIGS. 5 to 12, corner unit 41 is a generally U-shaped structure having an upright back 73, upright side flanges 74 and 75, and an upright front wall 76 secured together to form a generally upright enclosed pocket 77. The top of pocket 77 is open. Outer side flange 74 has a gusset portion attached to side rail 27. The lower end of post therefor 57 fits or telescopes into pocket 77 through the open end thereof. The bottom of corner unit 41 has a flat plate 78 attached to back 73, flanges 74 and 75, wall 76 and plug 46. When the lower end of post 56 is in pocket 77, the bottom of the post rests on plate 78. The side walls of post 56 are located close to the inside of back 73, flanges 74 and 75, and wall 76 to restrict lateral, front, and rear horizontal movements of post 56 and stabilize the upright position of post 56. Post 56 is an elongated square tubular member that fits into a square pocket 77. Other cross sectional shapes as rectangular or circular can be used for the post and structure providing pocket 77.

Figure 9:
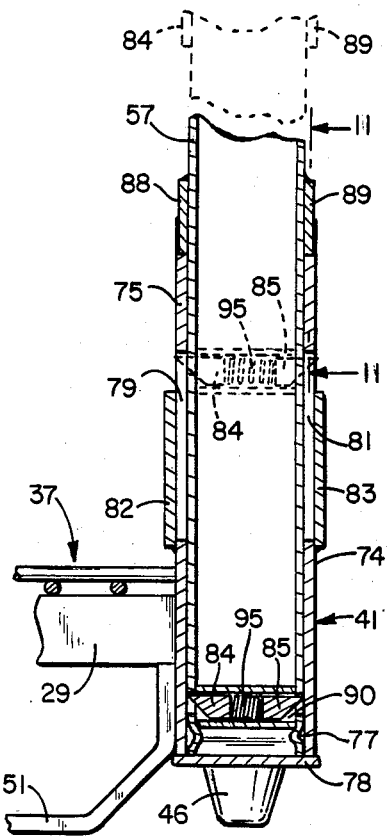
FIG. 9 is an enlarged sectional view taken along the line 9—9 of FIG. 5.
Figure 10:
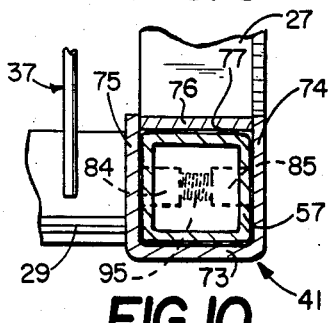
FIG. 10 is a sectional view taken along the line 10—10 of FIG. 7.
Figure 11:
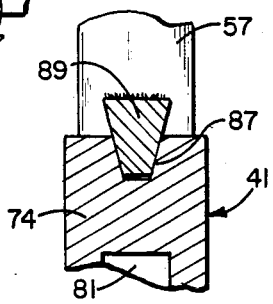
FIG. 11 is an enlarged sectional view taken along the line 11—11 of FIG. 9.
Figure 12:
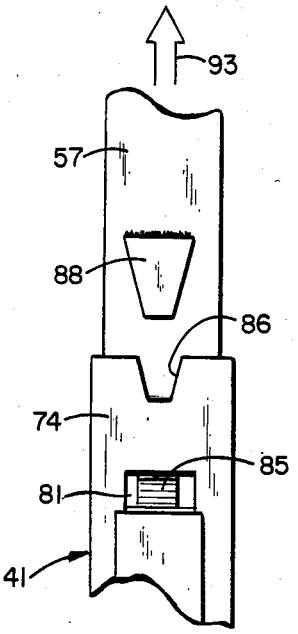
FIG. 12 is a view similar to FIG. 11 with the post moved to an up release position.

As shown in FIG. 9, side flanges 74 and 75 have upright aligned slots 79 and 81 partially covered with plates 82 and 83 secured to the outside of side flanges 74 and 75. A pair of spring biased locking members 84 and 85 extend through a transverse hole 90 in the lower end of post 63. The opposite ends of locking members 84 and 85 fit into slots 79 and 81. A compression spring 95 located between locking members 84 and 85 biases the locking members in opposite outward directions. The outer ends of locking members 84 and 85 slide on the inside surfaces of plates 82 and 83 to allow upright movement of post 57. Plates 82 and 83 function as stops to hold locking members 84 and 85 in hole 90 and assembled relation with the lower end of post 57. Slots 79 and 81 are elongated generally upright direction which allows post 57 to be moved upwardly relative to corner unit 41. When post 57 is in the up position, as shown in broken lines in FIG. 9, locking members 84 and 85 project through the opposite ends of hole 90 and engage portions 57B of the wall of post 57 which prevents locking members 84 and 85 from being pushed out of hole 90. The outer ends of locking members 84 and 85 engage the top edges of slots 79 and 81 in post 57 to prevent unintentional separation of post 57 from corner unit 41. The upper ends of slots 79 and 81 have sizes that permit locking members 84 and 85 to turn thereby allowing post 57 to be folded down adjacent floor 37. When posts 56 and 57 and associated end wall 22 are in the down or folded position locking members 84 and 85 prevent end wall 22 from separating from corner units 41 and 43. Posts 69 and 71 have similar locking members that cooperate with corner units 42 and 44 to retain end wall 23 in assembled relation with corner units 42 and 44.

The upper ends of side flanges 74 and 76 have V-shaped notches 86 and 87 in general vertical alignment with slots 79 and 81. Tabs 88 and 89 are secured to opposite sides of post 57 by welds or the like. Each tab 88 and 89 has the generally V-shape or taper with downwardly converging side edges that fit with a wedge fit into a notch. Tabs 88 and 89 in cooperation with pocket 77 for the lower end of post 57 hold post 57 in a generally upright position. Post 56 has a pair of tabs 91 and 92 secured to opposite sides thereof that fit into generally V-shaped notches in the top of corner unit 43. Posts 56 and 57 cooperating with corner units 41 and 43 hold end wall 22 in a generally upright position. End wall 23 can be folded to a generally horizontal position on top of floor 37. End wall 23 is initially raised as indicated by arrow 93 in FIG. 12. This moves tabs 88, 89, 91, 92 from the respective notches in corner units 41 and 43. End wall 22 can be swung to a down position as shown in FIG. 2.

Figure 5:
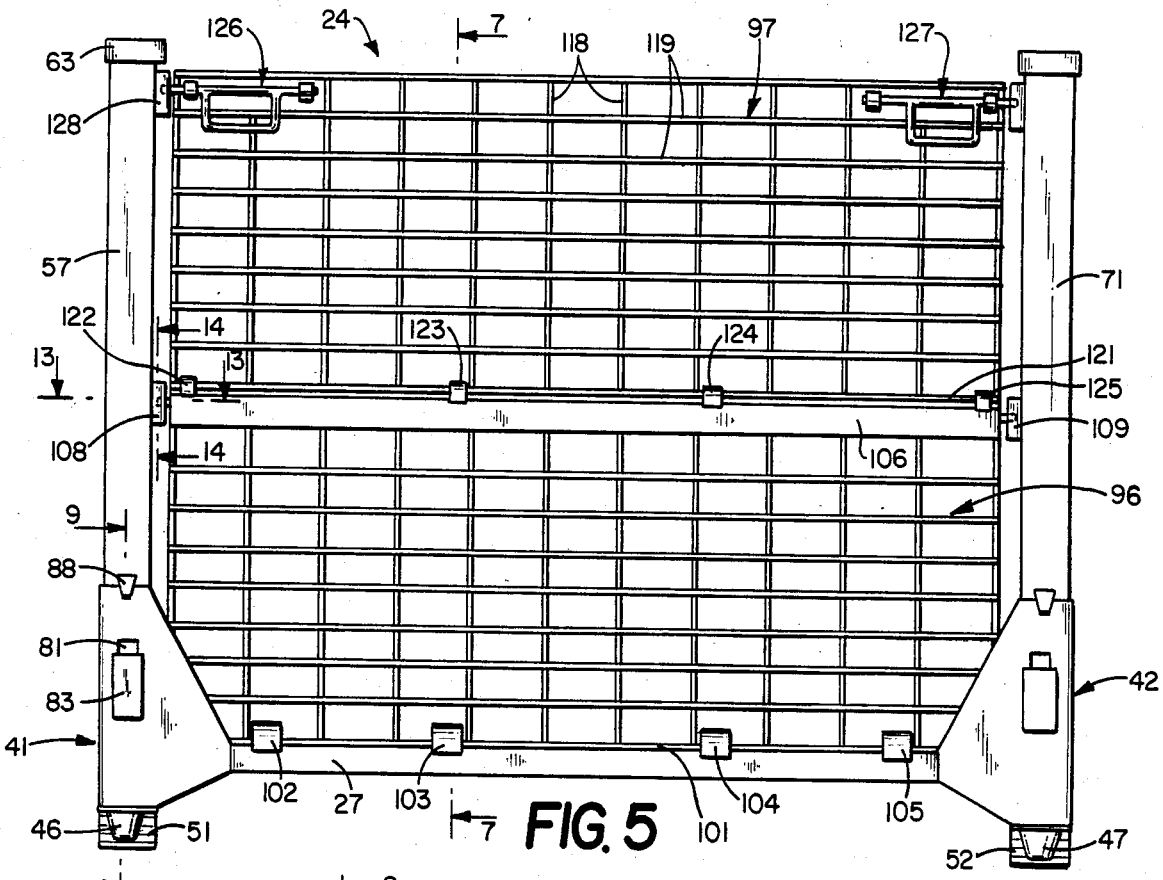
FIG. 5 is an enlarged side view of the container of FIG. 1.
Figure 7:
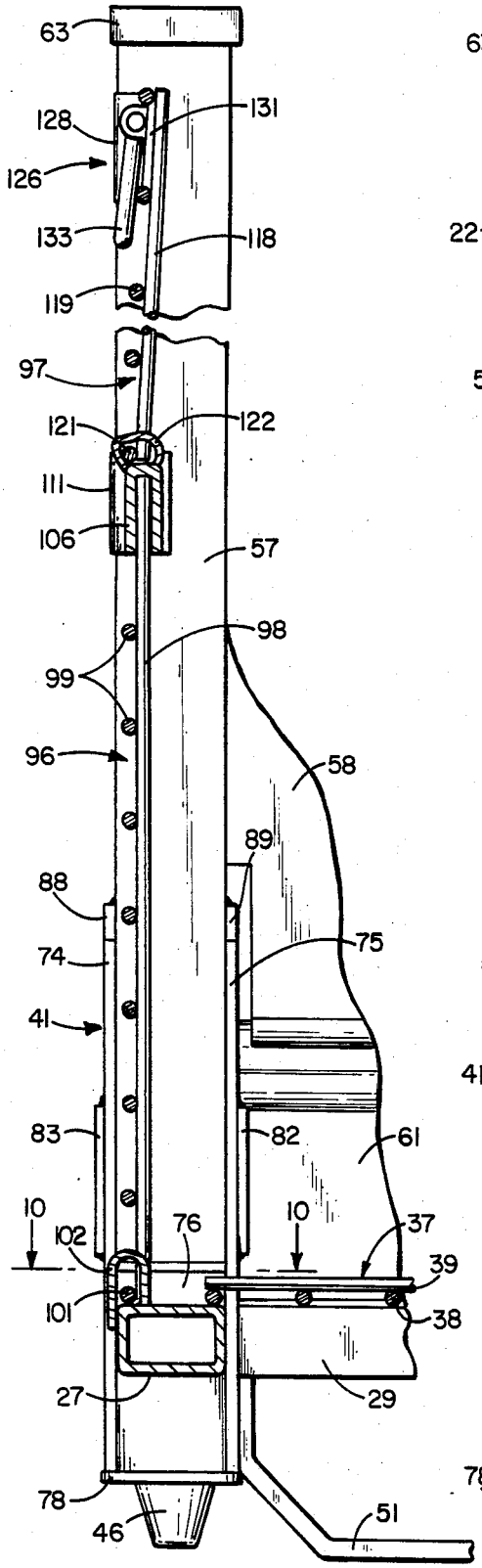
FIG. 7 is an enlarged foreshortened sectional view taken along the line 7—7 of FIG. 5.
Figure 13:
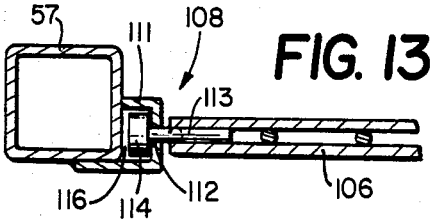
FIG. 13 is an enlarged sectional view taken along the line 13—13 of FIG. 5.
Figure 14:
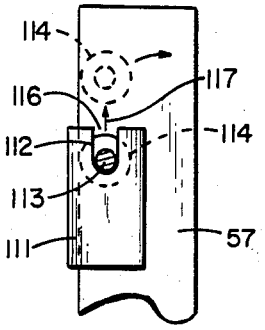
FIG. 14 is an enlarged sectional view taken along the line 14—14 of FIG. 5.

Side walls 24 and 26 are folding or drop gates that are identical in structure. The following description is limited to side wall 22 as shown in FIG. 5. Side wall 24 has a lower section 96 and an upper section 97 extended between posts 56 and 71. Lower section 96 comprises a plurality of laterally spaced upright rods 98 joined to a plurality of laterally spaced horizontal rods 99 to provide a mesh or grid-work gate. A horizontal bottom rod 101 extends through a plurality of inverted U-shaped hinge members 102, 103, 104, 105 secured to the top of side rail 27. A horizontal flat plate 106 is secured to the top rod 98 forming the top of lower section 96. Side wall 24 can be pivoted to a down or folded position adjacent the top of floor 37. Releasable latches or retainers 108 and 109 on posts 57 and 71 hold lower section 96 in a generally upright position. Retainers 108 and 109 are identical in structure. The following description is limited to retainer 108. As shown in FIGS. 13 and 14, retainer 108 comprises an upright bracket 111 having an upright groove or slot 112. Bracket 111 is a generally U-shaped member that is secured by welds or the like to the side of post 57. Groove 112 faces the end of side wall 24. A pin 113 is secured by welds or the like to the end of plate 106 facing bracket 111. Referring to FIG. 14, the lower section 96 of side wall 24 can be raised to remove head 114 from pocket 116 as indicated by arrow 117. This also releases retainer 109 on post 71. As shown in FIG. 7, hinge members 102–105 have elongated upright pockets that allow rod 101 to have limited upright movement. This movement is sufficient to allow pin 113 and its head 114 to be removed from pocket 116 of bracket 111.

Figure 17:
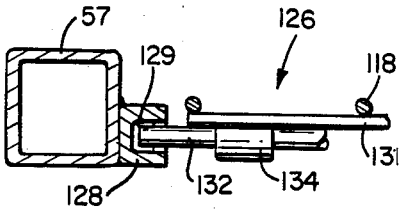
FIG. 17 is a sectional view taken along the line 17—17 of FIG. 15.
Figure 15:
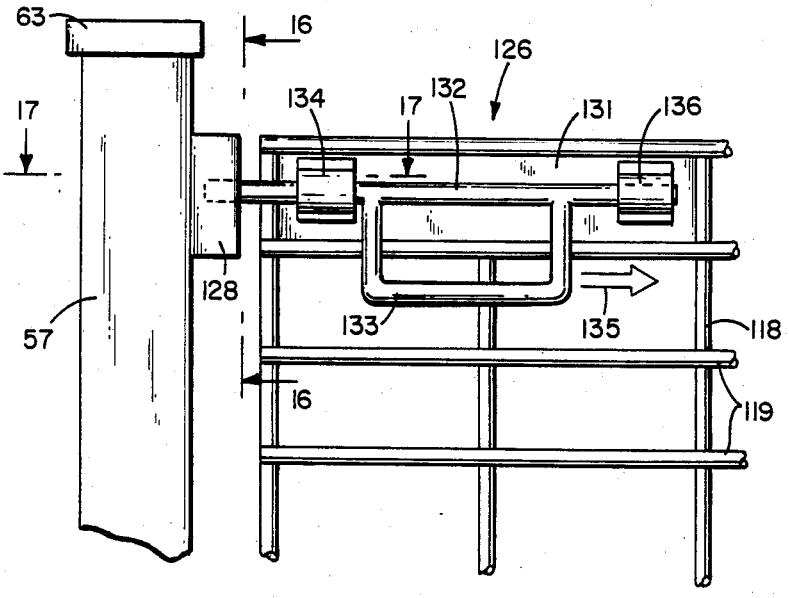
FIG. 15 is an enlarged side view of the lock assembly for the side wall.
Figure 16:
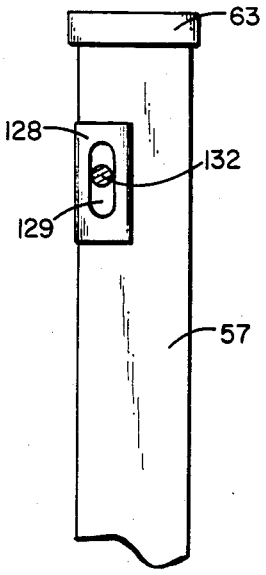
FIG. 16 is a sectional view taken along the line 16—16 of FIG. 15.

Upper section 97 has rod-grid structure comprising a plurality of laterally spaced upright rods 118 joined to a plurality of vertically spaced horizontal rods 119. The bottom rod 121 fits through a plurality of hinge members 122, 123, 124, and 125 secured to the top of plate 106. Hinge members 122–125 are generally inverted U-shaped members having a passage for accommodating rod 121. A pair of releasable latches 126 and 127 are secured to the upper opposite corners of the upper section 97. Latches 126 and 127 are identical in structure and function to hold the upper section 97 in a generally upright position between posts 57 and 71. Latches 126 and 127 also limit the upright movement of side wall 24 and hold the end walls in upright locking relation with corner units 41 and 43. Latch 126 has a block 128 secured to the upper end of post 57. As shown in FIGS. 16 and 17, block 128 has a hole 129 facing the upper section 97 of side wall 24. A plate 131 is secured to the upper corner of the upper section 97. A lock bolt 132 is slidably mounted on plate 131 with a pair of generally U-shaped ears 134 and 136. A U-shaped handle 133 secured to bolt 132 is used to facilitate the longitudinal movement of bolt 132 from a lock position as shown in FIG. 15 to a release or unlock position. When bolt 132 is in the lock position its end projects into hole 129 in block 128. Pin 128 limits upward movement of post 57 as wall 28 is connected to side beams 27. Side wall 28 when locked in the upright position retains posts 57 and 71 in their upright locked positions on corner units 41 and 42. Side wall 26 performs the same function for posts 56 and 69. When bolt 132 is moved in the direction of arrow 135 it is released from bracket 128. This allows upper section 97 to pivot downward to a folded position adjacent floor 37. Lower section 96 is raised to release retainers 108 and 109. The entire side wall 28 can then be folded to a flat position adjacent the top of floor 37. Side wall 26 is folded adjacent the top of floor 37 in a similar manner. The folded containers, as seen in FIG. 2, can be stacked for efficient storage thereof.

Container 20 is normally used in its erected position shown in FIG. 1. The side walls 24 and 26 are retained in their upright positions with retainers 108 and 109 and releasable locks 126 and 127. End walls 22 and 23 are held in the upright positions by corner units 41, 43, 42 and 44 respectively. The container 20 is folded to its collapsed position as shown in FIG. 2 without disassemblying any of its components in minimum of time and labor. This is accomplished by releasing latches 126 and 127 of the side walls 24 and 26. The upper sections of the side walls are folded in a downward position adjacent the inside of the lower sections of the side walls. The side walls 24 and 26 are then raised to release them from retainers 108 and 109. Each entire side wall can then be folded down onto the top of floor 37.

End walls 22 and 23 are folded to their down positions as shown in FIG. 2. The end walls 22 and 23 are raised until the bottom ends thereof clear pockets 77 in the corner units. Locking members 84 and 85 will move to the upper portions of the slots 79 and 81 as shown in broken lines in FIG. 9. Spring 95 biases the locking members 84 and 85 in outward directions so that the end walls cannot be removed from corner units 41 and 43. End walls 22 and 23 can then be pivoted or moved downwardly into their flat folded positions. Locking members 84 and 85 retain the end walls 22 and 23 in assembled relation with their associated corner units when they are in the folded position.

The end walls 22 and 23 can be removed from their associated corner units. Locking members 84 and 85 can be moved inwardly to released positions. This allows the lower ends of the posts to be moved upwardly out of the corner units. A new end wall can be readily inserted into the corner units.

Figure 18:
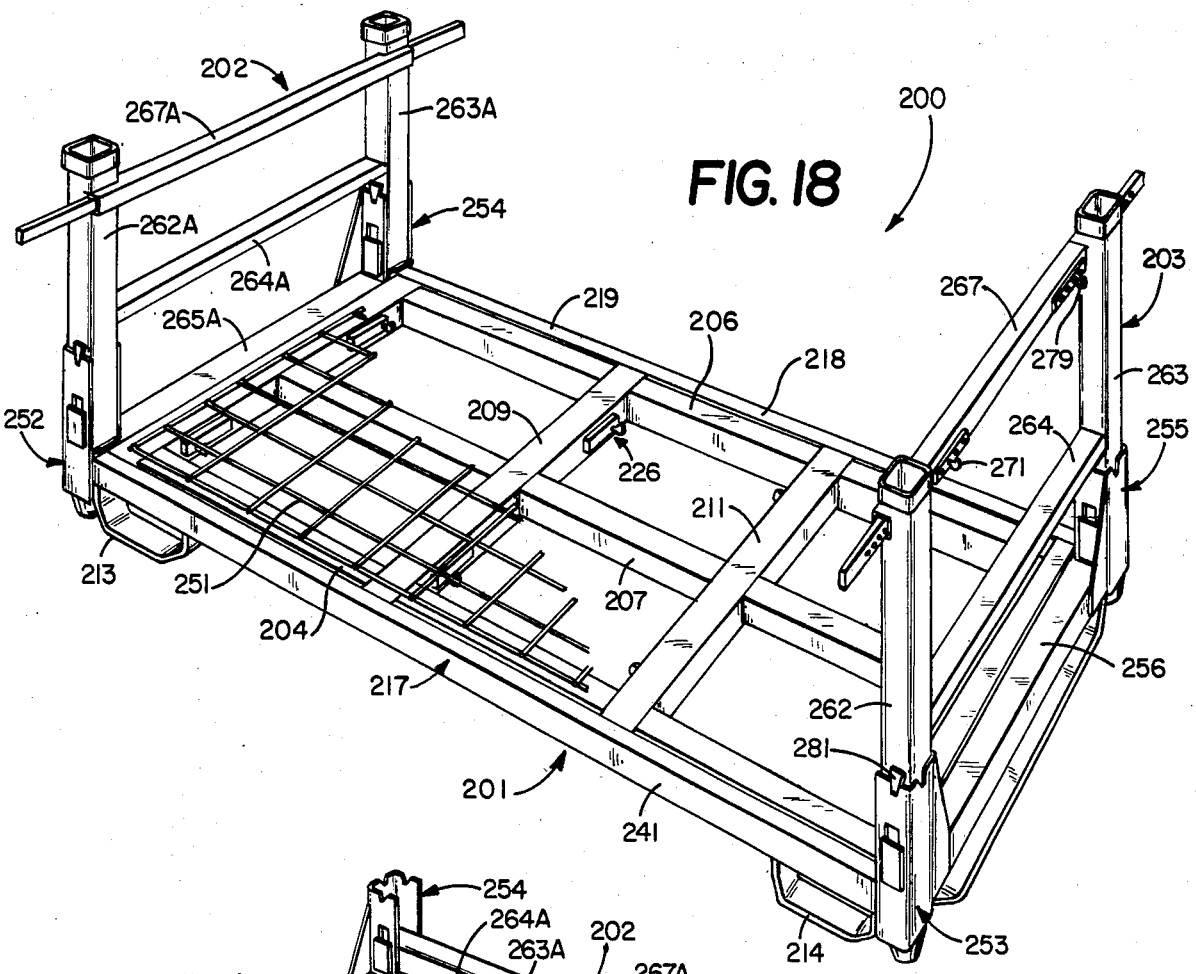
FIG. 18 is a perspective view of a modification of the container of the invention in its erected position.
Figure 19:
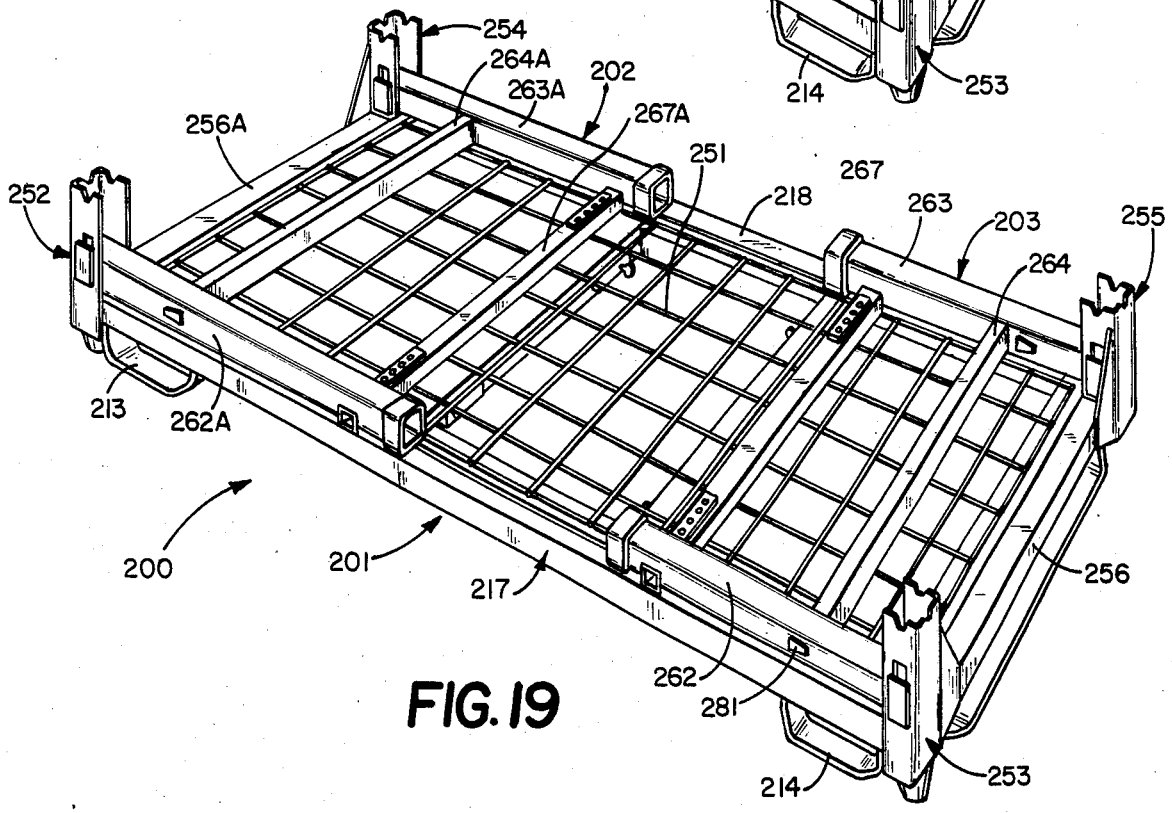
FIG. 19 is a perspective view of the container of FIG. 18 in the folded position.

Referring to FIGS. 18 and 19, there is shown a modification of the container of the invention indicated generally at 200. Container 200 in the erected position has upright end walls 202 and 203 joined to opposite ends of a base unit 201. The width of the base unit 201 can be expanded to accommodate wide objects. As shown in FIG. 19, container 200 can be collapsed by folding end walls 202 and 203 onto the top of base unit 201 to facilitate its transportation and storage.

Figure 20:
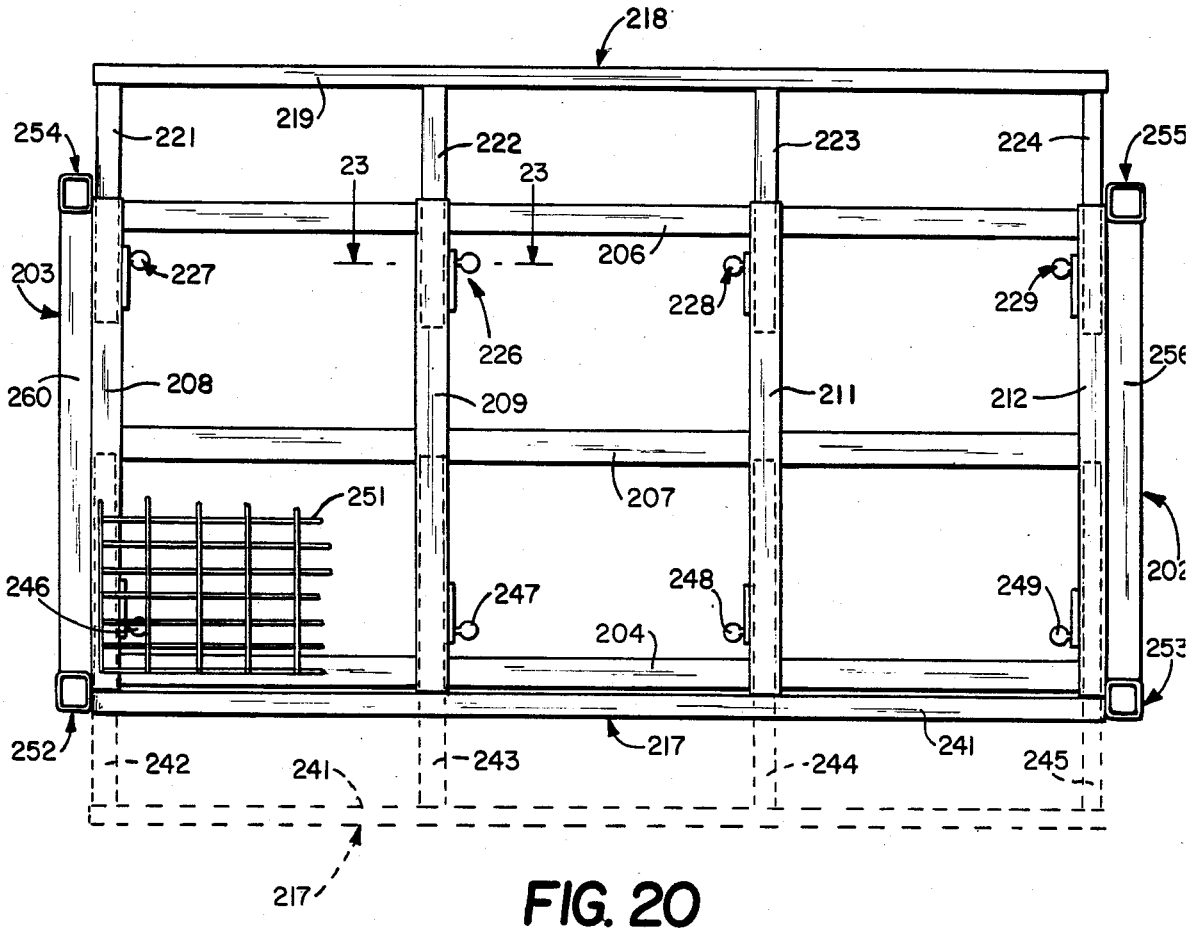
FIG. 20 is an enlarged top view of FIG. 17.
Figure 21:
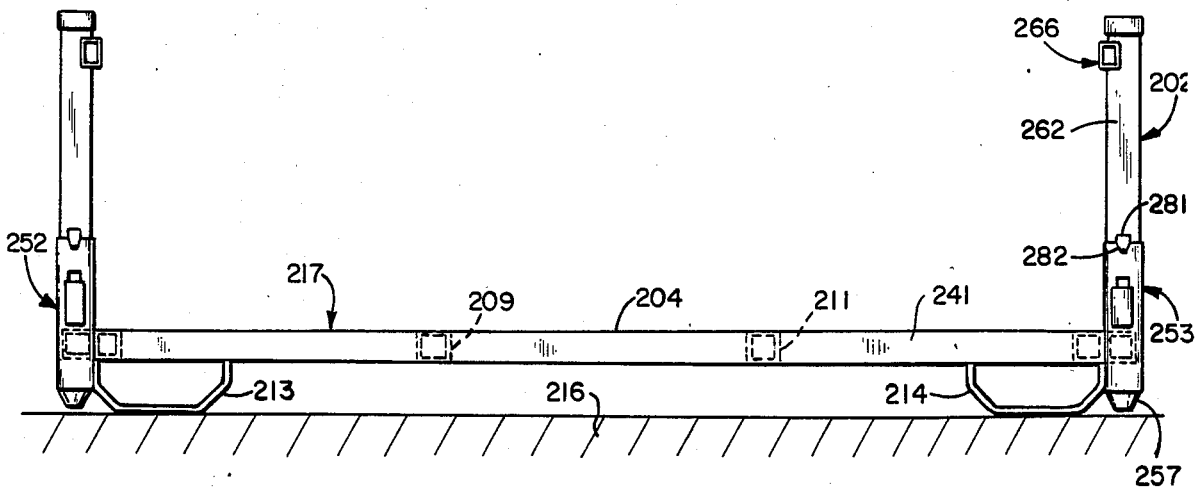
FIG. 21 is a side elevational view of FIG. 20.
Figure 22:
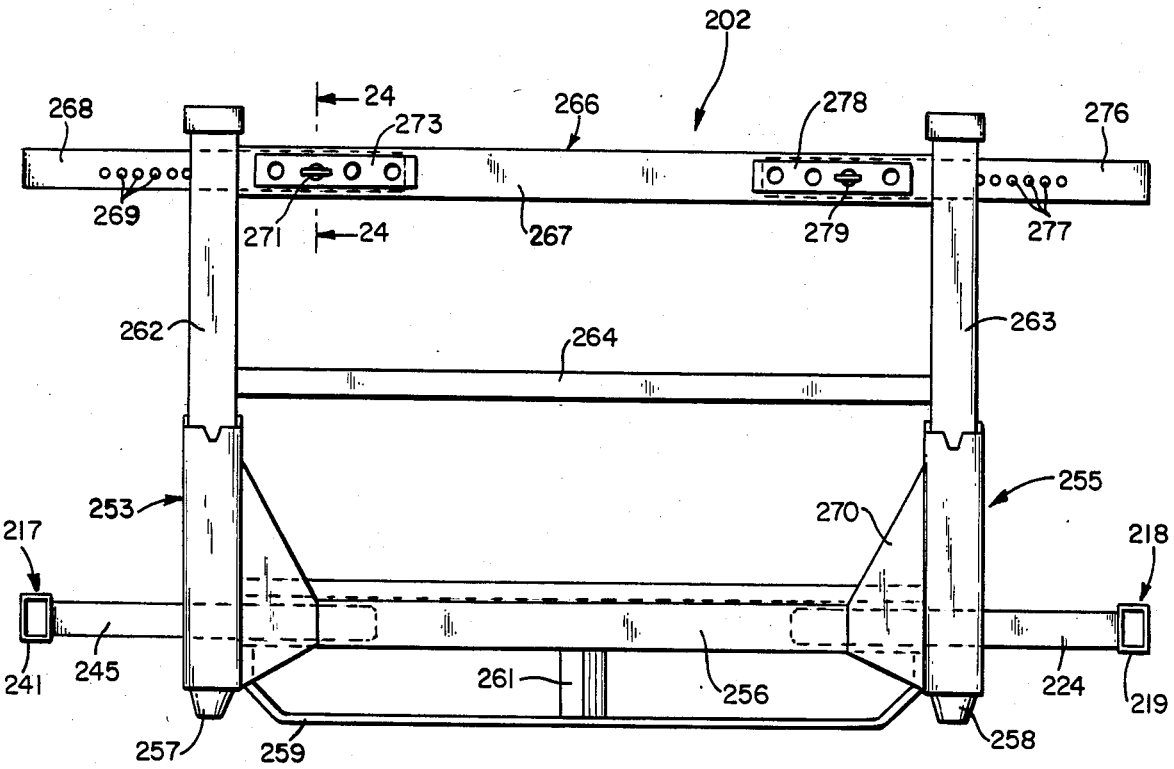
FIG. 22 is an end elevational view of FIG. 20.

Base unit 201, as shown in FIG. 20, has a pair of longitudinal side beams 204 and 206 located on opposite sides of a longitudinal center beam 207. A plurality of cross beams 208, 209, 211 and 212 extend between beams 204, 206, 207, and form therewith a generally rectangular frame structure. As shown in FIG. 21, ground engaging runners 213 and 214 secured to opposite ends of beam 204 serve as supports that engage the ground or floor 216 for base unit 201. Additional runners can be secured to beams 204, 206, and 207.

Figure 23:
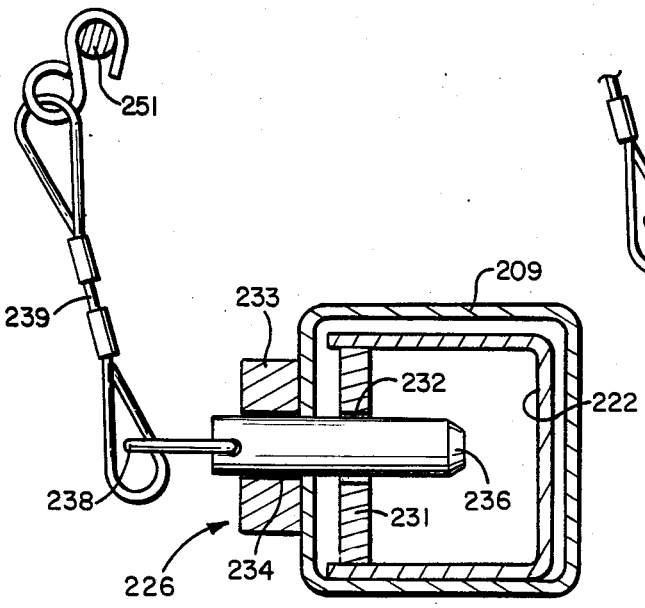
FIG. 23 is an enlarged sectional view taken along the line 23—23 of FIG. 20.
Figure 24:
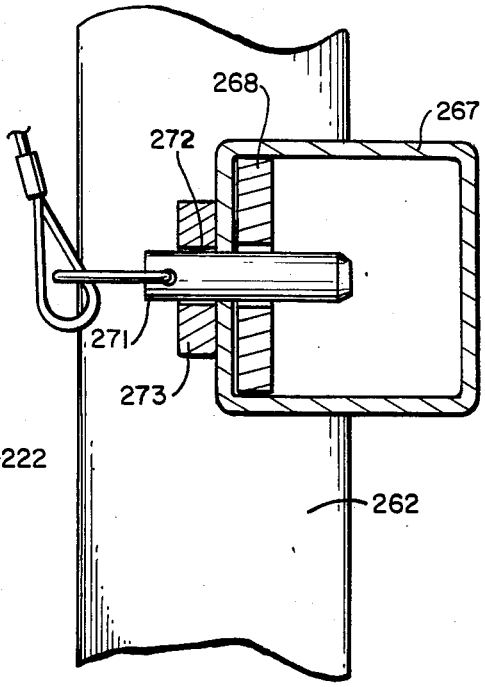
FIG. 24 is an enlarged sectional view taken along the line 24—24 of FIG. 22.

Returning to FIG. 20, base unit 201 has side extension units 217 and 218 adapted to be located in outward opposite lateral positions to increase the width of base unit 201. Extension unit 218 has a longitudinal side rail 219 and a pair of laterals arms 221, 222, 223, and 224. Arms 221–224 are longitudinally spaced along the length of rail 218 and slidably fit into the ends of transverse beams 208, 209, 211, and 212. FIG. 23 shows the sliding relationship between arm 222 and beam 209. Returning to FIG. 20, extension 218 is held in a fixed position with respect to longitudinal beam 206 with releasable lock pins indicated generally at 226, 227, 228, and 229. The lock pins are identical in construction. The following description is limited to lock pin 226. As shown in FIG. 23, arm 222 has a side wall 231 with a hole 232. A block 233 is secured to the outside of beam 209. Block 233 has a hole 234 accommodating lock pin 236. Pin 236 extends through hole 232 to prevent longitudinal movement of arm 222 relative to beam 209. Releasable holding structure, such as a locking clip (not shown) can be used with the outside end of pin 236 adjacent an eye 238 to lock pin 236 in assembled relation with block 233. A cable assembly 239 is used to retain eye 238 and pin 236 in assembled relation with base unit 201.

Extension unit 217 is identical in structure to the extension unit 218. Unit 217 has a longitudinal rail 241 joined to a plurality of arms 242, 243, 244, and 245. Arms 242–245 are slidably accommodated in the ends of the cross beams 208, 209, 211, and 212 respectively. Releasable lock pins 246, 247, 248, and 249 hold the arms in a selected position relative to cross beams 208, 209, 211 and 212.

A floor 251 comprising a wire mesh is located over and secured to the lontitudinal beams 204, 206, and 207 and cross beams 208, 209, 211, and 212. The floor 251 can be a wood plank floor in lieu of the wire mesh.

As shown in FIG. 20, corner units indicated generally at 252, 253, 254, and 255 are joined to the corners of the bottom unit 201. The corner units 252–255 are substantially identical in structure to the corner unit 41 shown in FIGS. 5 to 12. Each corner unit has laterally spaced upright side walls joined to a front wall and a rear wall. A transverse gusset plate 270 is secured to one side wall. These walls surround a open top enclosed pocket in the lower portion of the corner unit. The upper ends of the side walls have notches for accommodating tabs on posts 262, 263, 263A, and 264A. The lower ends of posts 262, 263, 263A and 264A when in upright positions telescope into the pockets and the tabs fit in the notches in the side walls to retain the upright positions of the posts. As shown in FIG. 21, a cross end beam 256 is joined to corner units 253 and 255. A similar cross beam 260 extends between corner units 252 and 254. Plugs 257 and 258 secured to the bottoms of corner units 253 and 255 are used for stacking the container on additional containers. A transverse runner 259 is located between corner units 253 and 255 below end beam 256. Runner 257 is joined to an upright central post 261 attached to the middle of end beam 257. Runner 259 has a generally flat bottom surface adapted to support the container on the floor 216.

End wall 202 has upright columns or posts 262 and 263 mounted in the upright assembled relation with corner units 253 and 255. A cross member 264 is joined to the mid-sections of posts 262 and 263. The lower ends of posts 262 and 263 are movably attached to corner units 253 and 255 with releasable locking members (not shown). The structure of locking members is shown in detail in FIGS. 9 and 10.

An extender assembly indicated generally at 266 is located across the upper ends of posts 262 and 263. Extender assembly 266 comprises a generally horizontal box beam 267 extended between and secured to the upper ends of posts 262 and 263. A first plate 268 is slidably located in one end of beam 267. Plate 268 has a plurality of holes 269 to allow for lateral adjustment of plate 268 relative to post 262. A lock pin 271 shown in FIG. 23, used to hold plate 268 in fixed relation relative to post 262. Lock pin 271 extends through a hole 272 in a bar 273 secured to the side of cross member 267. Releasable holding structure, such as a lock clip (not shown) associated with pin 271 holds pin 271 in assembled relation with bar 273.

A second bar 276 is slidably accommodated in the opposite end of cross member 267. Bar 272 has a plurality of holes allowing for selected lateral adjustment thereof. A plate 278 secured to cross member 267 accommodates a lock pin 279 used to move bar 276 in its selected position relative to column 263. End wall 203 has the same structure as end wall 202. The parts of wall 203 that corresponds to wall 202 have the same reference numbers with the suffix A.

In use, container 200 is erected by locking end walls 202 and 203 in upright positions on their respective corner units. The end walls 202 and 203 are pivoted in an upright position adjacent opposite ends of container 200. The corner units 253 and 255 hold the end wall 202 in an upright position. The corner units 252 and 254 hold the end wall 203 in an upright position. Each post has a pair of tabs 281 that fit into generally V-shaped grooves 282 in an associated corner unit to releasably lock the end wall in the generally upright position onto base unit 201. Extension units 217 and 218 can be moved to their out positions by initially releasing lock pins 226–229 and 246–249. When the extension units 217 and 218 are in their desired positions, the lock pins 226–229 and 246–249 are replaced. Container 200 is ready to be loaded with cargo or objects to be shipped.

Container 200 can be reverted to its collapsed storage position by folding end members 201 and 202 down against the top of the base unit. This is accomplished by elevating the end walls 202 and 203 thereby releasing the locking tabs from the corner units. The end walls 202 and 203 can then be pivoted toward each other adjacent the top of base unit 201, as shown in FIG. 19. Extension units 217 and 218 are moved to their in positions. This is achieved by removing lock pins 227–229 and 246–249 and sliding arms 217 and 218 into the ends of the cross beams 208, 209, 211, and 212. Lock pins 227–229 and 246–249 are then reinserted into their respective holes thereby holding the extension units 217 and 218 in their in positions.

While there has been shown and described preferred embodiments of the container of the invention it is understood that changes in the structures including the base unit, end walls, and corner units may be made by those skilled in the art without departing from the invention.

The embodiments of the invention in which an exclusive property or privilege is claimed are defined as follows:

1. A container for holding objects and the like comprising: a floor unit having a frame including side members and end members, floor means mounted on the side and end members, corner means secured to adjacent ends of each side member and end member, each corner means having generally upright wall means providing an open top enclosed pocket, said wall means having at least one generally upright slot and an upper portion containing at least one upwardly open notch, posts mounted on the corner means, means movably connecting the posts to the corner means including locking means projected into said slot, means for biasing said locking means into said slot, said posts having lower ends located in said enclosed pockets in the corner means, and tab means secured to said posts located in said notches when the posts are in a generally upright position, said lower ends of said posts being movable out of the pockets and the tabs means movable out of the notches whereby the posts and walls secured to the posts can be folded down adjacent the floor means.

2. The container of claim 1 wherein: the upright wall means of each corner means includes upright side walls, a front wall, and a rear wall surrounding said pockets, said lower ends of the posts being telescoped into the pockets and engageable with said side, front and rear walls.

3. The container of claim 2 wherein: the upper portions of said side walls have notches, said tab means including tabs located in said notches when the posts are in the upright positions.

4. The container of claim 3 wherein: each notch is generally V-shaped and each tab has converging edges that fit into said V-shaped notch.

5. The container of claim 2 wherein: said upright side walls each have at least one generally upright sot, said locking means including a locking member projected into each slot.

6. The container of claim 5 wherein: said means for biasing said locking means being operable to bias said locking members into said slots.

7. The container of claim 1 wherein: said upright wall means of each corner means has a pair of opposite upright slots, said locking means including a first locking member projected into one slot and a second locking member projected into the other slot, said means for biasing said locking means including biasing means for biasing the first and second locking members into said slots.

8. The container claim 7 wherein: said biasing means comprises a spring located between said first and second locking members.

9. A container for holding objects and the like comprising: a floor unit having a frame including side members and end members, said floor unit having extension means for increasing a linear dimension of the floor unit, means movably mounting the extension means for increasing a linear dimension of the floor unit, means movably mounting the extension means on the frame whereby the width of the floor unit can be adjusted, corner means secured to adjacent ends of each side member and end member, each corner means having generally upright wall means providing an open top enclosed pocket, said wall means having an upper portion containing at least one upwardly open notch, posts mounted on the corner means, means movably connecting the posts to the corner means, said posts having lower ends located in said enclosed pockets in the corner means, and tab means secured to said posts located in said notches when the posts are in a generally upright position, said lower ends of the posts being movable out of the pockets and the tab means movable out of the notches whereby the posts and walls secured to the posts can be folded down adjacent the floor means.

10. The container of claim 9 including: lock means for holding the extension means on the frame in a selected adjusted position.

11. The container of claim 1 including: generally upright side walls located between adjacent posts, means movably mounting the side walls on the frame for movement to generally upright positions and folded positions on the floor unit, and releasable holding means on the side walls and posts for holding the side walls in generally upright positions.

12. The container of claim 12 wherein: said releasable holding means including first means secured to the posts and second means secured to the side walls and engageable with the first means to hold the side walls in generally upright positions and hold the posts in assembled upright relation with said corner means.

13. A container for holding objects comprising: floor means having a frame for supporting one or more objects, a plurality of corner means secured to said frame, each of said corner means having generally upright walls providing an open top pocket, a generally upright post mounted on each corner means, said post having a lower end located in said pocket, said post and walls having cooperating means to hold the post in a generally upright position on the corner means, said post being movable out of the pocket to release said cooperating means whereby the post can be moved to a position adjacent said floor means, said upright walls of each corner means has at least one generally upright slot, locking means mounted on the post projected into the slot to limit upright movement of the post relative to the corner means and, means for biasing said locking means into said slot.

14. The container of claim 13 wherein: said upright walls of the corner means includes upright side walls, a front wall, and a rear wall surrounding said pocket, said lower end of the post being telescoped into said pocket and engageable with said side, front, and rear walls.

15. The container of claim 13 wherein: said cooperating means include cooperating notches and tabs on said posts and upright walls of the corner means.

16. The container of claim 13 wherein: said upright walls have a pair of opposite upright slots, said locking means including a first locking member projected into one slot and a second locking member projected into the other slot, and said means for biasing said locking means comprising biasing means for biasing said first and second locking members into the slots.

17. A container for holding objects comprising: floor means having a frame for supporting one or more objects, a plurality of corner means secured to said frame, each of said corner means having generally upright walls providing an open top pocket, a generally upright post mounted on each corner means, said post having a lower end located in said pocket, said post and walls having cooperating means to hold the post in a generally upright position on the corner means, said post being movable out of the pocket to release said cooperating means whereby the post can be moved to a position adjacent said floor means, said floor means having extension means for increasing a linear dimension of the floor means, means movably mounting the extension means on the frame, and lock means for holding the extension means on the frame in a selected adjusted position.

18. The container of claim 13 including: generally upright side walls located between adjacent posts, means movably mounting the side walls on the frame for selected movement to generally upright positions and folded positions adjacent the top of the floor means, and releasable holding means on the side walls and posts for holding the side walls in generally upright positions.

19. The container of claim 18 wherein: said releasable holding means include first means secured to the posts and second means secured to the side walls and engageable with the first means to hold the side walls in generally upright positions and hold the posts in assembled relation with said corner means.

20. A container for holding objects comprising: floor means having a frame for supporting one or more objects, a plurality of corner means secured to said frame, wall means having generally upright posts mounted on said corner means, said posts and corner means having cooperating means which hold the wall means in a generally upright position and allow the wall means to be moved to a folded position adjacent the top of the floor means, said floor means having extension means for increasing a linear dimension of the floor means, means movably mounting the extension means on the frame, and lock means for holding the extension means on the frame in a selected adjusted position.

21. The container of claim 20 wherein: said corner means and posts having cooperating upright slot means and locking means to limit upright movement of the posts relative to the corner means and retain the posts in assembled relation with said corner means.

22. The container of claim 20 wherein: said corner means has at least one generally upright slot, and locking means mounted on the posts projected into the slot to limit upright movement of the posts relative to the corner means.

23. The container of claim 20 wherein: said corner means has a pair of opposite upright slots, said locking means including a first locking member projected into one slot and a second locking member projected into the other slot, and biasing means for biasing said first and second locking members into said slots.

24. The container of claim 20 wherein: each corner means includes upright side walls, front wall, and a rear wall surrounding an open top enclosed pocket, said lower end of the post being telescoped into said pocket and engageable with said side, front and rear walls to hold said posts in a generally upright position.

25. The container of claim 24 wherein: said cooperating means includes cooperating notches and tabs on said posts and corner means.

26. The container of claim 20 wherein: said corner means and posts have cooperating upright slot means, locking means extended into the slot means to limit upright movement of the wall means relative to the corner means and retain said wall means in assembled relation with said corner means and means for biasing the locking means into the slot means.

27. A container for holding objects comprising: a floor unit having a frame with corners, floor means mounted on the frame, corner means secured to the corners of the frame, walls extended upwardly from the frame, each end wall having a pair of upright posts, each post has a lower end, each corner means having generally upright wall means providing an open top enclosed pocket in the lower portion thereof and a U-shaped portion in the upper portion thereof open toward the opposite corner means, said lower end of each post located in a pocket and U-shaped portion when the end walls are located in upright positions, each of said posts and wall means having cooperating means to hold the end walls in generally upright positions, said posts being movable out of the pockets to release said cooperating means whereby the end walls can be moved to folded positions adjacent said floor means, said upright wall means of each corner means has generally upright slot means, locking means mounted on each post projected into the slot means to limit upright movement of the walls relative to the corner means and retain the walls in assembled relation with the corner means and biasing means for biasing said locking means into the slot means.

28. The container of claim 27 wherein: said cooperating means include cooperating notches and tabs on said posts and upright wall means of the corner means.

29. The container of claim 27 wherein: said locking means including a pair of locking members projected into said slot means, and said biasing means yieldably holding said locking members into the slot means.

30. The container of claim 27 wherein: said floor means has extension means for increasing a linear dimension of the floor means, means movably mounting the extension means on the frame, and lock means for holding the extension means on the frame in a selected adjusted position.

31. The container of claim 37 including: generally upright side walls located between adjacent posts, means movably mounting the side walls on the frame for selected movement to generally upright positions and folded positions adjacent the top of the floor means, and releasable holding means on the side walls and posts for holding the side walls in generally upright positions.

32. The container of claim 31 wherein: said releasable holding means include first means secured to the posts and second means secured to the side walls and engageable with the first means to hold the side walls in generally upright positions and hold the posts in assembled relation with said corner means.

33. A container for holding objects comprising: floor means having a frame for supporting one or more objects, a plurality of corner means secured to said frame, a generally upright post mounted on each corner means, said post and corner means having cooperating restraining means to hold the post in a generally upright position on the corner means, said post being movable relative to the corner means to release said cooperating restraining means whereby the post can be moved to a position adjacent said floor means, said floor means having extension means for increasing at least one linear dimension of the floor means, means movably mounting the extension means on the frame, and means for holding the extension means on the frame in a selected adjusted position.

34. The container of claim 33 wherein: said extension means comprises a first extension movably mounted on one side of the frame and a second extension movably mounted on the opposite side of the frame, said means for holding the extension means comprising separate locks for holding the first and second extensions on the frame in selected adjusted positions.

35. A container usable to hold objects, said container having corner means generally upright posts mounted on each corner means comprising: a floor means having a frame for supporting one or more objects, corner means secured to the floor means, a generally upright post means mounted on each corner means, said post means and corner means having cooperating restraining means to hold the post means in a generally upright position on the corner means, said post means being movable to a position to release said cooperating means, said corner means having wall means with at least one generally upright slot, locking means mounted on the post means projected into said slot to limit upright movement of the post means relative to the corner means and allow the post means to be moved relative to the floor means, and means for biasing and holding said locking means in said slot, said means for biasing and holding said locking means allowing the locking means to be moved out of said slot whereby the post means can be removed from said corner means.

36. The container of claim 38 wherein: said floor means includes extension means for increasing at least one linear dimension of the floor means, means movably mounting the extension means on the frame, and lock means for holding the extension means on the frame in a selected adjusted position, said extension means comprises a first extension movably mounted on one side of the frame and a second extension movably mounted on the opposite side of the frame, said means for holding the extension means comprising separate locks for holding the first and second extensions on the frame in selected adjusted positions.

37. A container for holding objects comprising: floor means for supporting one or more objects, a plurality of corner means secured to said floor means, a generally upright post mounted on each corner means, said post and corner means having cooperating restraining means to hold the posts in a generally upright position on the corner means, said post being movable to a position to release said cooperating means whereby the post can be moved to a position adjacent said floor means, said corner means having wall means with at least one generally upright slot, locking means movably mounted on the post projected into the slot to limit upright movement of the post relative to the corner means, and allow the post to be moved adjacent the floor means, and means for biasing said locking means into said slot.

38. The container of claim 37 wherein: each of said corner means has a pair of upright walls provided with a pair of opposite upright slots, said locking means including a first locking member projected into one slot and a second locking member projected into the other slot, and said means for biasing said locking means comprising biasing means engageable with said first and second locking members for biasing said first and second locking members into said slots.

39. The container of claim 38 including: plate means secured to said upright walls partially covering the outside of said slots to hold the first and second locking members in assembled relation with said post.

40. A container for holding objects and the like comprising: a floor unit for supporting objects, corner means secured to adjacent ends of the floor unit, each corner means having generally upright wall means, said wall means having at least one generally upright slot, and an upper portion containing at least one upwardly open generally V-shaped notch, post means mounted on the corner means, cooperating means for restraining the post means in a generally upright position, said cooperating means including lower portions of said post means engageable with said corner means, locking means projected into said slot to limit upright movement of the post means, means for biasing the locking means into said slot and generally V-shaped tab means secured to said post means, said generally V-shaped tab means being complimentary in size and shape to said generally V-shaped notch means whereby when said tab means are located in said notch means the post means are retained in their generally upright positions, said post means being movable away from the corner means whereby the tab means moves out of the notch means and the lower portions of the post means are released from the corner means allowing the post means to be folded down adjacent the floor means.

41. The container of claim 40 wherein: each of said corner means have generally upright wall means providing an open top and a closed pocket, said post means having lower ends located in said pocket when the post means are in their generally upright positions.

42. The container of claim 40 wherein: said locking means is movable out of said slot whereby the post means can be removed from said corner means.

43. The container of claim 42 including: plate means secured to said upright wall means partially covering the outside of said slot to hold the locking means in assembled relation with said post means.

44. A container for holding objects and the like comprising: a floor unit for supporting objects, corner means secured to adjacent ends of the floor unit, each corner means having generally upright wall means, said wall means having a pair of opposite upright slots, and an upper portion containing at least one upwardly open generally V-shaped notch, post means mounted on the corner means, cooperating means for restraining the post means in a generally upright position, said cooperating means including lower portions of said post means engageable with said corner means, locking means projected into said slots to limit upright movement of the post means, said locking means including a first locking member projected into one slot and a second locking member projected into the other slot, biasing means for biasing the first and second locking members into said slots, said first locking member and second locking member being movable out of the respective slots whereby the said post means can be removed from said corner means, and generally V-shaped tab means secured to said post means, said generally V-shaped tab means being complimentary in size and shape to said generally V-shaped notch means whereby when said tab means are located in said notch means the post means are retained in their generally upright positions, said post means being movable away from the corner means whereby the tab means moves out of the notch means and the lower portions of the post means are released from the corner means allowing the post means to be folded down adjacent the floor means.

45. The container of claim 44 including: plate means secured to said upright walls partially covering the outside of said slots to hold the first and second locking members in assembled relation with said post means.

* * * * *